United States Patent [19]

Eubanks

[11] Patent Number: 4,791,419

[45] Date of Patent: Dec. 13, 1988

[54] MICROWAVE ABSORBING MEANS

[76] Inventor: Gary R. Eubanks, 316 Westridge Dr., Raleigh, N.C. 27609

[21] Appl. No.: 812,374

[22] Filed: Dec. 23, 1985

[51] Int. Cl.[4] ..... H01Q 17/00

[52] U.S. Cl. ..... 342/1; 342/4; 342/13

[58] Field of Search ..... 342/1–4, 342/13, 172, 447; 343/895, 713, 905

[56] References Cited

U.S. PATENT DOCUMENTS 3,955,199 5/1976 Hutzelman et al. ..... 342/172

OTHER PUBLICATIONS

R. F. Graf Dictionary of Electronics, 1974, p. 263.

*Primary Examiner*—Thomas H. Tarcza
*Assistant Examiner*—Mark Hellner
*Attorney, Agent, or Firm*—Rhodes, Coats & Bennett

[57] ABSTRACT

This invention is a device for absorbing microwave-type radio signals from a radar sending unit. The above is accomplished by providing a transformer effect with a conductive material which is connected to a signal neutralizing gas such as that found in fluorescent light tubes.

6 Claims, 1 Drawing Sheet

MICROWAVE ABSORBING MEANS

FIELD OF INVENTION

This invention relates to radio signals and more particularly to radar type signal means.

BACKGROUND OF INVENTION

Speed traps set up by unscrupulous law enforcement personnel have always been the bane of law abiding motorists. Because of this, radar detectors have been developed and are now in widespread use but these are expensive to purchase, quite often become outdated in a short time, and can be a source of harassment from local officials even though they are legal to use.

Basically, radar is an electronic system for determing the direction and range of anything that will reflect microwave radio signals. Traffic control radar is a microwave signal beamed toward the vehicle being monitored with such waves being reflected back to the radar unit. The unit then interprets the changing frequency of the microwaves received from the approaching vehicle, and based upon the time difference in the returning microwave, computes the speed of the vehicle according to such frequency change.

BRIEF DESCRIPTION OF INVENTION

After much research and study into the above-mentioned problems, the present invention has been developed to provide an absorber for radar type microwaves which either prevents or weakens the return signal. The radar waves which strike the vehicle are attracted to the absorber by a transformer effect created by an electrical conductor mounted on said vehicle. The wave energy is then lead into a fluorescent tube which causes the wave to be neutralized or absorbed by the gas therein.

DETAILED DESCRIPTION OF INVENTION

With further reference to the drawings, the microwave absorbing means of the present invention, indicated generally at 10, is composed of a microwave attracting portion or antenna 11 and a microwave neutralizing or absorbing portion 12. The attracting portion 11 is in the form of a fifty foot length of twelve to fourteen gage solid conductor insulated copper wire. This wire is wound around the absorbing portion 12 which is preferably a twenty-four inch fluorescent light tube filled with the normal gas found in such tubes.

The microwave attracting wire is wound tightly about the exterior of the absorbing tube in helical fashion with one end of such wire being connected by twisting, soldering or the like to one of the elements at one end of the fluorescent tube with the other end of such wire being connected to the other element of the tube at the opposite end from the first connection.

A pair of the thus formed absorbing means are mounted on the vehicle 15, preferably in an end-to-end configuration. A preferred location giving the greatest target area is between the grill and radiator of the vehicle and either above or below any large metal objects such as metal bumpers, etc.

Insulated brackets can be used for the mounting of the absorber means and can be connected to any convenient part of the vehicle. Since mounting brackets of this type are well known to those skilled in the art, further detailed discussion of the same is not deemed necessary.

Figure 1:
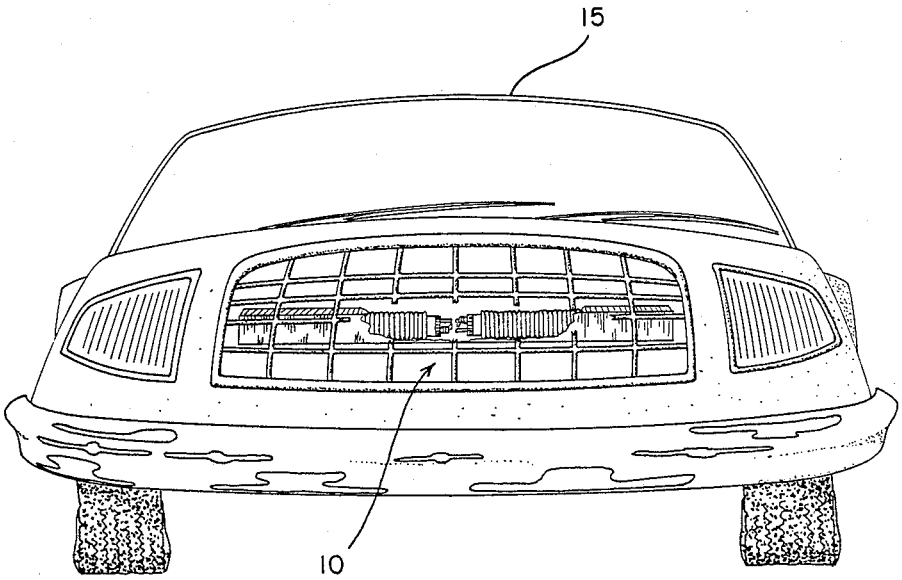
FIG. 1 is a front elevational view of a typical vehicle with the microwave absorbing means of the present invention mounted thereon.
Figure 2:
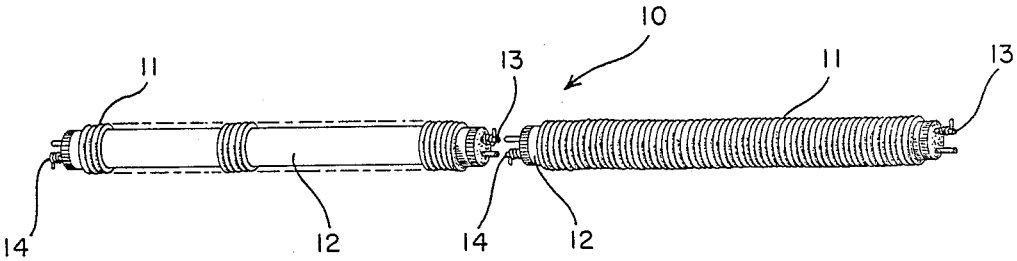
FIG. 2 is a perspective view of the absorber means in its preferred mounting arrangement.
Figure 3:
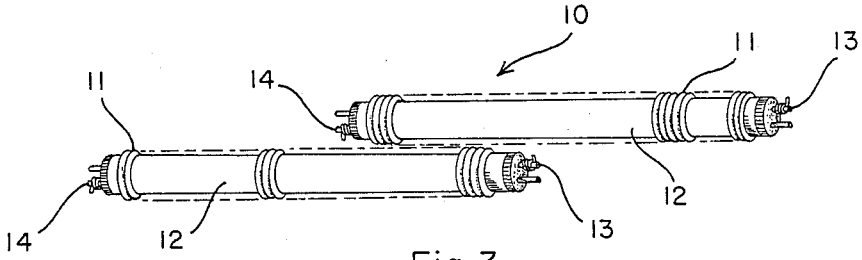
FIG. 3 is a perspective view of the absorbing means in an alternative mounting.

When space does not permit the preferred mounting shown in FIG. 2, the pair of absorbing means 10 can be mounted in staggered relationship as shown in FIG. 3. The overlappage, when mounted in this configuration, should be held to a minimum with the outer ends being as far apart as possible.

Figure 4:
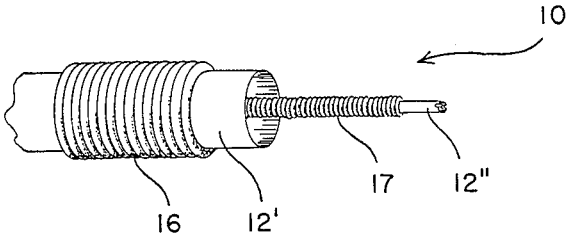
FIG. 4 is a cut away perspective view of an alternate absorber design.

The configuration shown in FIG. 4 has been especially developed to provide dual absorbing antennas, the outer antenna 16 having its absorbing tube 12' being filled with a mixture of neon gas and mercury vapor while the interior antenna 17 has its absorbing tube 12'' filled with a mixture of argon gas and mercury vapor. The relationship of the attracting portion and the absorbing portion, i.e., the helical wire and tube, as well as the terminal connections for this version (FIG. 4) are the same as described for the absorbing means 10 shown in FIGS. 2 and 3 except 22 gage wire is used.

In the version shown in FIG. 4, the antenna 16 is specifically designed for absorb beam X-band radar microwaves while the antenna 17 is specifically designed for absorbing K-band radar microwaves.

The mounting of the version shown in FIG. 4 is of course the same as earlier described for the version shown in FIGS. 2 and 3.

Once the microwave absorbing means 10 of the present invention has been installed on a vehicle as hereinabove described, and the vehicle has microwaves beamed at it from a traffic radar, such waves will be attracted to the absorber by the transformer effect created by the helically disposed copper wire. This wave energy is conducted into the fluorescent tubes where such waves are neutralized or absorbed by the gases therein.

From the above it can be seen that the present invention has the advantage of providing a relatively simple and yet highly efficient means for absorbing traffic radar signals thus greatly reducing or eliminating the driver from being stopped in a speed trap zone. The present invention does not aesthetically detract from the vehicle on which it is installed, it requires no external energy to operate, and it will last indefinitely.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed:

1. A microwave absorbing means comprising: absorbing tube means filled with a gaseous medium for absorbing microwave radiation; antenna means electrically coupled to said absorbing tube for receiving said microwave radiation and transmitting the same to said absorbing tube, said antenna means including a helical, electrical conductor wound about said absorbing tube means; and means for mounting said absorbing tube means on a vehicle whereby a device is provided for weakening the return signal of traffic type radar.

2. The absorbing means of claim 1 wherein said absorbing tube means includes first and second absorbing tubes, each filled with a gaseous medium; said second absorbing tube being disposed interiorly of said first absorbing tube.

3. The microwave absorbing means of claim 2 wherein said first absorbing tube is filled with a mixture of neon gas and mercury vapor.

4. The microwave absorbing means of claim 2 wherein said second absorbing tube is filled with a mixture of argon gas and mercury vapor.

5. The microwave absorbing means of claim 2 wherein said first absorbing tube is filled with a mixture of neon gas and mercury vapor and said second absorbing tube is filled with a mixture of argon gas and mercury vapor.

6. The absorbing means of claim 2 including first and second antenna means, said first antenna means including a helical, electrical conductor coupled to and wound about said first absorbing means, said second antenna means disposed within said first absorbing tube and including a helical, electrical conductor coupled to and wound about said second absorbing tube.

* * * * *